United States Patent [19]

Pearson

[11] Patent Number: 5,050,868

[45] Date of Patent: Sep. 24, 1991

[54] LEG TRAINING MACHINE FOR BODY BUILDERS

[75] Inventor: Bruce E. Pearson, Searcy, Ark.

[73] Assignee: Criterion Bodybuilding Equipment, Inc., Searcy, Ark.

[21] Appl. No.: 494,447

[22] Filed: Mar. 16, 1990

[51] Int. Cl.[5] ..... A63B 21/06

[52] U.S. Cl. ..... 272/117; 272/123

[58] Field of Search ..... 272/93, 117, 118, 123, 272/134

[56] References Cited

U.S. PATENT DOCUMENTS

| | | | |
|---|---|---|---|
| 3,612,523 | 10/1971 | Glynn | 272/118 |
| 4,527,797 | 7/1985 | Slade, Jr. et al. | 272/123 |
| 4,540,171 | 9/1985 | Clark et al. | 272/123 X |
| 4,601,466 | 7/1986 | Lais | 272/118 |
| 4,795,149 | 1/1989 | Pearson | 272/117 |
| 4,834,364 | 5/1989 | Gongwer et al. | 272/93 |
| 4,955,604 | 9/1990 | Pogue | 272/117 X |

FOREIGN PATENT DOCUMENTS

| | | | |
|---|---|---|---|
| 2328486 | 10/1975 | France | 272/118 |

*Primary Examiner*—Robert Bahr

*Attorney, Agent, or Firm*—Stephen D. Carver

[57] ABSTRACT

An exercising machine for bodybuilders which facilitates the safe and proper performance of various lower body exercises such as squats and lunges. The machine safely facilitates free, natural movements in two planes to promote muscle growth and bone and tendon strength. The machine is ideally suited to use as a rehabilitation device. A rigid steel frame of generally rectangular configuration rests upon a resilient, skid-resistant mat. The frame comprises rigid, spaced apart side rails and parallel cross members. A carriage assembly is slidably disposed upon the rails for movement along the frame. The carriage assembly includes a pair of rigid, parallel arches which extend vertically from roller assemblies associated with the frame rails. The roller assemblies comprise twin-bearing pillow blocks which permit the carriage to roll securely along the rails. A weight bar system extending between carriage sides may be loaded as desired by the bodybuilder. The weight bar system includes a horizontal weight bar contacted by the exerciser and rotatable, offset weight supports. A padded yoke associated with the weight bar harnesses the exerciser to the machine. Vertical guide rods associated with each side of the carriage assembly establish a vertical path for defining upward and downward movement of the weight bar. Weight bar sleeves coaxially mated to the guide rods enable vertical movement of the weight bar during operation. A weight bar restraint system safely retains the weight bar in a desired elevated position until released by manipulation of an associated pair of handgrips by the exerciser. A selectively positionable auxiliary drop bar prevents injury to the bodybuilder as a result of inadvertent release of the weight bar assembly during operation.

4 Claims, 5 Drawing Sheets

LEG TRAINING MACHINE FOR BODY BUILDERS

BACKGROUND OF THE INVENTION

The present invention relates generally to exercising equipment for muscle conditioning, muscle rehabilitation, and body building. More particularly, the present invention relates to bodybuilding or weight training machines for the practice of lunges, squats, and the like. With the addition of a proper bench, many exercises of the upper body can also be performed, such as bench presses and rows.

This invention comprises an improvement of my earlier invention entitled LUNGE TRAINING MACHINE FOR BODY BUILDERS, described and claimed in U.S. Pat. No. 4,795,149, issued to me on Jan. 3, 1989, which is hereby incorporated by reference herein.

It has long been known to exercise and build up muscle tissue with bar bells or conventional weight systems. Weight machines have been widely used to aid in safe and controlled power bodybuilding. Such bodybuilding machines are usually designed to encourage repetitions of a variety of desired exercises to increase strength, endurance, and speed.

For example, squats, which strongly stress the quadriceps, the buttocks, and the lower back muscles, were traditionally performed with a barbell balanced across the bodybuilder's back, and the legs slowly bent to a squatting position. "Hack squats", which stress the quadriceps in relative isolation from the remainder of the body, can be performed with traditional "free weight" barbells or with conventional hack machines which are relatively popular in modern gymnasiums. Lunge exercises, which stress the quadriceps, buttocks, and upper ham strings, are also conventionally performed with barbells. When the lunge position is assumed, one leg will be moved forward and the other leg will remain in place, stressing the forward leg only.

During bodybuilding exercises it is important that the bodybuilder maintain proper kinetics of movement as well as proper form and ranges of movement. In free weight exercises, the bodybuilder must carefully maintain balance while in motion to prevent injury. To assure safety during free weight exercises, the bodybuilder typically reduces the amount of weight used. As a result, muscle growth and development of tendon and bone strength can be limited, and only part of the target muscle groups could be exercised appropriately. With the use of properly designed exercising machines, the bodybuilder is better able to observe proper form and routine while using larger amounts of weight.

For safety purposes, free weight exercises require the use of "spotters" to stand near the bodybuilder when the barbells are being lifted. Some form of safety-catch rack or equipment may also be used to prevent the heavy barbells from dropping if the bodybuilder experiences a muscle cramp or the like. Machines adapted to "control" weights such as barbells are ideally adapted to promote these safety aspects.

Various types of weight exercise machines have been proposed in the prior art. For example, Martin, U.S. Pat. No. 3,707,285, issued Dec. 26, 1972 teaches a weight lifting station comprising a rectangular weight bar-supportive framework adapted to extend between the floor and the ceiling of an exercise area. The bodybuilder may position himself in a variety of ways upon and between supportive crossmembers traversing the framework. A progressive resistance exercising apparatus is disclosed by Uyeda et al. in U.K. Patent No. GB 2,052,274-A, published Jan. 28, 1981. The latter apparatus comprises a single column framework which supports a vertically reciprocative weight carriage controlled by a handlebar-type grip. When the bar is pressed or pulled downwardly by the bodybuilder, the weights are elevated along the track.

The football training device defined by Jackson in U.S. Pat. No. 3,866,914 issued on Feb. 18, 1975 comprises a weight-supportive carriage which extends angularly, generally diagonally between opposite vertical frame members. As the exerciser pushes the weight support upwardly along the carriage certain preselected distances, additional weight members are engaged to increase the resistance experienced by the exerciser during use. Slade et al., U.S. Pat. No. 4,527,797, issued July 9, 1985, disclose a barbell support system comprising a rigid vertical framework having two pairs of opposing vertical legs. A weight bar-supportive carriage slides vertically upon opposing shafts positioned between the legs. The carriage is retained in a selected desired position by rigid support rods which are manually inserted through parallel orifices defined in opposing pairs of legs.

Various prior art bars and machines incorporate some form of weight-bar collar or weight offsets to enhance manipulability and balance. For example, the early U.S. Pat. No. 1,013,782, issued to Koch on Jan. 2, 1912 teaches the use of offset weights mounted on barbells. Moore, U.S. Pat. No. 3,370,850 issued Feb. 27, 1968 illustrates the use of a shoulder harness unit associated with an offset weight support bar. The collar evenly distributes weight about the shoulders and frees the hands of the user for improved balance. U.S. Pat. No. 3,904,198 issued Sept. 9, 1975 to Jones discloses the desirability of offsetting weights from the weight bar and providing rotatable handgrips for more even distribution of weight. U.S. Pat. No. 3,010,720 issued to Allard on Nov. 28, 1961 discloses an exercise rack comprising a selectively displaceable shoulder-mounted weight collar for facilitating the performance of squat exercises. The weight bar of U.S. Pat. No. 4,252,316 issued to Price on Feb. 24, 1981 comprises a freely rotatable end sleeve from which weights are supported offset and perpendicular to the weight bar. Goodwin, U.S. Pat. No. 4,200,280, issued Apr. 29, 1980 and Zinkin U.S. Pat. No. 2,932,509 issued Apr. 12, 1960 disclose weight rack devices having offset yoke or handlebar arrangements.

However, most prior art machines known to me are not directed specifically to the performance of various lower body building exercises. Most prior bodybuilding machines do not allow movement of the exerciser's body in more than one plane. Unfortunately, limiting the body's range of movement to one plane hinders coordination and greatly increases stresses experienced by the joints, tendons, and bone structure. I have designed a machine which enables a bodybuilder to safely perform various squats, lunges, and similar lower body building exercises while urging the bodybuilder to maintain proper form and a high degree of safety. In particular, the exercise of "Smith Machine" squats, "Free Weight" squats, "Smith Machine" front squats, "Free Weight" front squats, Sissy squats, and Good Mornings, or Stiff Leg Deadlifts, is facilitated. With the addition of a bench, the bodybuilder may also use the machine to perform bench presses, incline bench presses, shoulder presses, Behind-the-Neck shoulder presses, upright rows, and bent-over rows.

My lunge training machine disclosed in U.S. Pat. No. 4,795,149 has proven quite effective for performing these various lower body exercises. However, as a result of experimentation with my lunge training machine, I have developed new structure which facilitates the performance of numerous other exercises. Through experimentation, I have also discovered certain disadvantages associated with its use. These disadvantages are addressed and overcome by the present modified and improved structure.

For example, the exercise carriage of my previous invention is slidably mounted within a rigid, generally cubical steel framework comprising opposing pairs of vertical stanchions spaced apart by rigid horizontal tracking rails. The framework is very large and somewhat cumbersome to install. Importantly, tracking along opposing parallel top and bottom rails of the prior design has also proved problematic, since forces are not always applied uniformly along the bar. Consequently, undesired sticking or dragging of the carriage has been experienced in some instances. The present somewhat-modified design is more practical, more stable, much more easily maneuvered, and less expensive to construct. Means are provided in the present improved structure for resiliently compensating for slight variations in the width of the framework top and bottom portions as well.

The framework of my prior machine is adapted to be stationed upon or mounted to the existing supporting floor of the gym or other workout area. This has proven disadvantageous, because an unprotected or smooth floor surface can prevent the exerciser from achieving adequate traction to successfully perform power squats or lunges. In addition, damage to the floor surface may result. Protective cushions or traction mats would have to be custom-cut to fit within the framework, thus limiting their usefulness for other applications. The present improved structure incorporates a skid-resistant, protective cushion base.

It has also proven desirable to provide a selectively positionable weight bar to accommodate different exercisers and facilitate the performance of different types of exercises. Means for conveniently repositioning and safely securing the weight bar at different heights are provided in the present improved apparatus. In addition, the present structure provides improved means for orienting the weight bar and the associated yoke-like collar in various user-selective positions. Thus, the weight-collar bar frees the bodybuilder's hands so that proper technique can be accomplished while safe balance is maintained. Because the present machine facilitates natural movement and relieves stresses on the exerciser, it is ideally suited for use as a rehabilitation device.

SUMMARY OF THE INVENTION

The present invention comprises a smoothly operating, safety-conscious exercising machine for the practice of squats, lunges, and similar exercises. The machine encourages the bodybuilder to adopt proper exercise form, and it safely enables and facilitates repetitions of exercise sets designed to strengthen the legs and lower body. The machine may also be used in conjunction with a bench for improved, safe performance of upper body exercises. Because it assists in the safe performance of a wide variety of natural body movements, the machine is ideally adapted for use as a rehabilitation device as well.

Preferably the machine comprises a rigid frame of generally rectangular dimensions supported upon the gym floor or other supporting surface, such as a concrete slab. The frame encloses a cushioned, skid-resistant base upon which the exerciser stands. A sliding carriage is dynamically associated with the frame. The carriage comprises a pair of similar, spaced-apart arches, whose parallel legs form the opposite edges of the carriage sides. The inverted tops of the carriage arches extend between the carriage sides, synchronizing the carriage. The arch legs are secured to support plates slidably disposed upon twin, horizontal slide rails associated with the frame. The twin sliding support plates form the bottom of the carriage assembly.

A roller system associated with the carriage support plates enable the carriage to slidably roll along the rails over the frame. Hand-controlled carriage locks may be selectively deployed by the operator to temporarily secure the carriage at either end of the rails to facilitate the performance of stationary exercises or safe storage of the apparatus.

The carriage sides are reinforced by spaced-apart crossmembers. Opposing pairs of vertical guide rods mounted within the carriage sides between the twin arches slidably mount a dynamic weight-bar assembly. The guide rods associated with each arch member establish a vertical path for establishing upward and downward weight bar movement. The weight bar system includes a pair of sleeves, including linear bearings for mounting the weight bar to the guide rods for axial movements. A substantially horizontal portion of the weight bar is mounted to the sleeves to facilitate weight bar rotation, so that the bodybuilder may conveniently assume different exercise movements and positions.

Weight supports extend outwardly through the carriage. The weight ends are offset from the central horizontal portion of the weight bar and may be loaded as desired with removable weights by the bodybuilder to achieve the desired stress level. In the best mode, a yoke associated with the weight bar means engages the neck and shoulders of the exerciser. Pads are preferably associated with the yoke for comfort. The yoke harnesses the exerciser to the weight bar system, which in turn couples the exerciser to the carriage.

For enhanced safety, the machine includes a weight restraint system which permits the bodybuilder to temporarily position the weight bar at a desired height for set up or for the performance of an exercise. A drop bar system limits downward travel of the weight bar to prevent injury to the bodybuilder when the weight bar is inadvertently dropped.

Thus a basic object of the present invention is to provide an improved machine for enabling a bodybuilder to safely perform weighted squats, lunges, calf raises, good mornings, power squats and various other exercises.

Another basic object of the present invention is to provide an exercising machine of the character described which facilitates body movements in several planes, and safely distributes and controls the weight load.

Another basic object is to provide an improved exercise machine as described which encourages proper form.

Another object is to provide an improved exercise machine which permits the bodybuilder to safely use larger amounts of weight to facilitate complete muscle conditioning and muscle rehabilitation.

A still further object is to provide a bodybuilding machine of the character described which is ideal for use by bodybuilders in conditioning their lower body.

A further object is to provide a bodybuilding machine which facilitates natural movement in two planes during exercising.

One further object is to provide a bodybuilding machine of the nature described which may be used in conjunction with a bench for improved performance of upper body exercises.

Yet another object of the present invention is to provide a weight training system of the character described wherein the weights are restrained from falling past a preselected point.

Another object of the present invention is to provide a weight training system of the character described which allows a more natural, unique range of motion and affords enhanced stabilization.

A fundamental object of the present invention is to provide an improved lunge training machine of the character described which facilitates forward and rearward body movement simultaneous with upward and downward weight movement.

A related object is to provide a weight exercising machine of the character described which facilitates both muscle isolation and stress intensification.

A specific object of the present invention is to provide a weight exercising machine which ensures maximum muscle-fiber participation for building greater muscle mass and strength.

A further specific object of the present invention is to provide a weight exercising machine which may be used in conjunction with a bench for safely facilitating bench presses, shoulder presses, and rows in a natural free-weight manner.

Another object of the present invention is to provide a weight exercising machine which reduces undue strain on the lower back and concentrates weight on the legs during the performance of various leg exercises.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
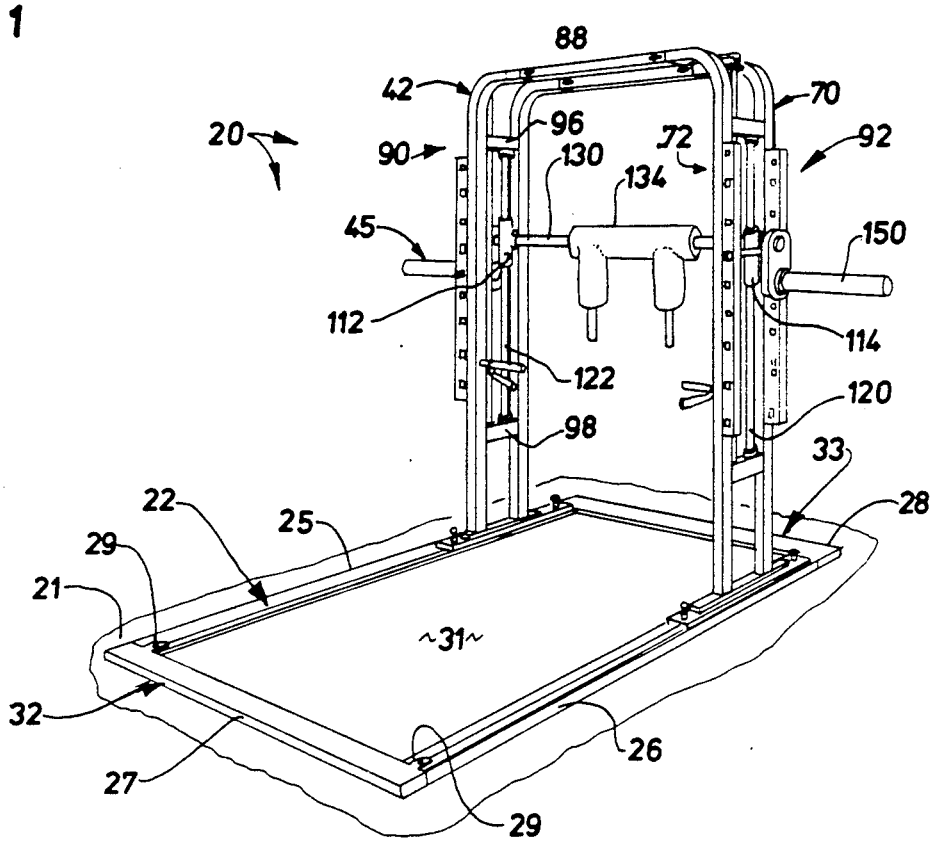
FIG. 1 is a perspective view showing the best mode of my Leg Training Machine for Bodybuilders.

With initial reference now directed to FIG. 1 of the appended drawings, a weight training machine constructed in accordance with the best mode of the present invention has been generally designated by the reference numeral 20. Machine 20 is disposed upon a convenient supporting surface 21 such as a concrete floor or the like. By virtue of its novel design, the machine permits the bodybuilder more natural movement in multiple planes and facilitates maximum muscle-fiber participation during exercise.

Machine 20 includes a generally rectangular and planar frame broadly designated by the reference numeral 22, which surrounds a a skid-resistant base 31. The frame supports a movable carriage assembly 42, to be described in detail hereinafter. The carriage assembly slides over suitable rails extending between the front and rear of the frame. A weight bar assembly broadly designated by the reference numeral 45 extends between the carriage sides. Machine 20 facilitates the performance of a wide variety of leg and lower body exercises. In addition, the machine 20 may be used in combination with a weight bench for upper body exercises such as presses and rows.

The frame 22 comprises a pair of parallel side rails 25 and 26 spaced apart by parallel front and rear cross braces 27 and 28. Frame 22 surrounds a resilient, skid-resistant base 31. The frame front has been generally designated by the reference numeral 32 and the frame rear has been generally designated by the reference numeral 33. As best viewed in FIGS. 6 and 7, each of the rails 25, 26 comprises an elongated, preferably cylindrical shaft 25A centered between pairs of rigid vertical guide walls 25W. Rails 25, 26 terminate at both ends in rigid safety latches 29 which may be selectively deployed to lock the carriage assembly 42 into position at the front or the rear of frame 22. Resilient springs or the like are axially mounted upon the rear end of rails 25, 26 adjacent frame rear 33. The springs resiliently respond to cushion impacts from the carriage assembly when it is rolled to the rear of frame 22. The rails slidably support the roller assemblies 48, which in turn support the carriage assembly 42.

Figure 7:
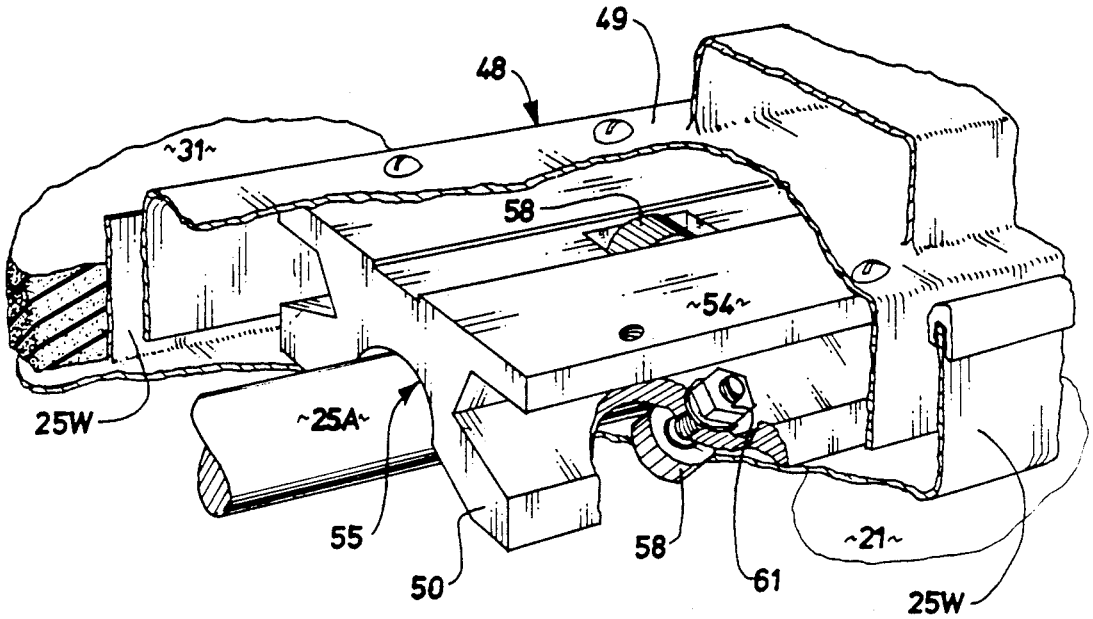
FIG. 7 is an enlarged, fragmentary perspective view of the preferred roller assembly with parts broken away or shown in section for clarity.

As best viewed in FIG. 7, each roller assembly 48 comprises a rigid plate 49 formed of elongated, channel steel. Roller bearings 50 are secured at each end of plate 49. Conventional bolts secure the roller bearings 50 underneath plate 49. Each roller bearing 50 comprises a rigid collar 54 having a generally concave central portion 55 which slidably contacts rail 25. Triple guide bearings 58 slidably capture rail shaft 25A and are secured by conventional bolt and washer combinations 61. As will be appreciated, it would be possible to configure roller bearings 50 to properly dynamically engage rail shafts of differing geometry.

Figure 6:
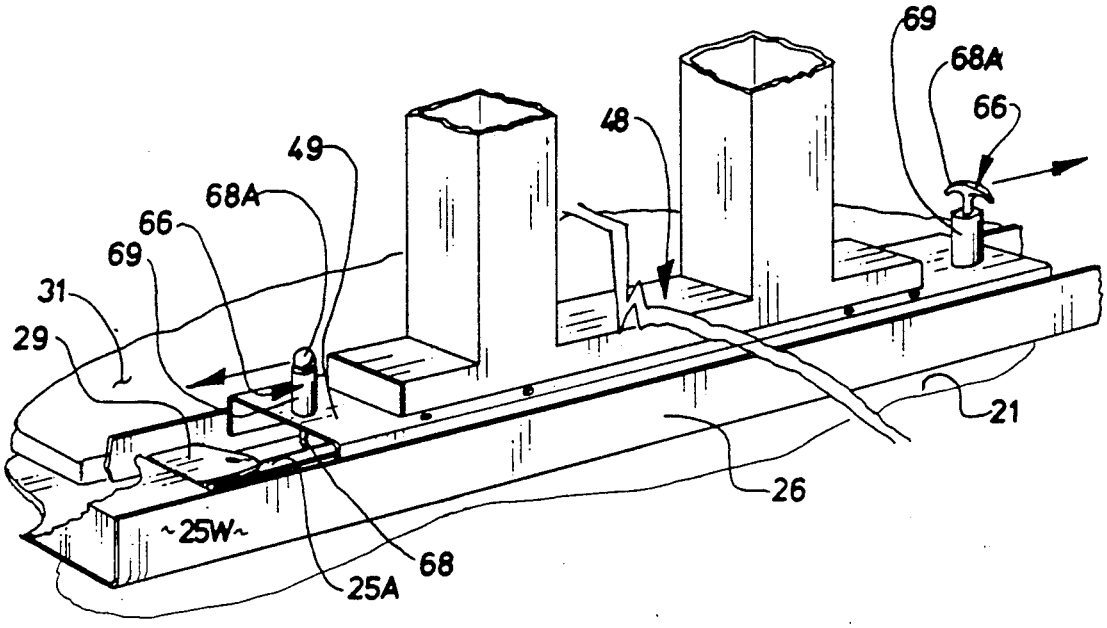
FIG. 6 is a fragmentary, perspective view of the preferred rail assembly in which parts have been broken away for clarity.

With reference directed to FIG. 6, locks 66 are provided at either end of the roller assembly 48. Locks 66 engage latches 29. Each lock 66 comprises a cylinder 68 slidably disposed within a housing 69. Cylinder 68 terminates at its upper end in a handle 68A. A rigid pin transversely penetrates housing 69 to elevate it above rail shaft 25A. When it is desired to lock the carriage assembly into position at the front 32 or rear 33 of frame 22, the bodybuilder grasps handle 68A and pulls upwardly on the cylinder 68. When the plate 49 is subsequently slid into position over latch 29, the cylinder 68 is released and drops into engagement with latch 29. It will be appreciated that various types of safety locking members might be adapted for use with the present system.

As best viewed in FIG. 1, base 31 comprises a rectangular section of durable, resilient material such as molded polyethylene. The base is secured within the frame 22. Base 31 protects the floor 21 from being marred or scratched, and also dampens noise from operation of the machine. Most importantly, base 31 provides a skid-resistant surface which enhances traction for the bodybuilder and cushions impacts experienced by the bodybuilder. Hence undesired muscle fatigue is reduced. Where desired, an esthetically pleasing design, such as the manufacturer's trademark or pictorial instructions, may be molded into the upper surface of the base and provide additional traction surface.

With reference now directed primarily to FIGS. 1–2 and 4 and 6, carriage assembly 42 slides between the frame front 32 and rear 33. Carriage assembly 42 comprises a pair of spaced-apart arches 70, 72. Each arch 70, 72 comprises a pair of legs 82, 84 integrally terminating in upper curved ends 86 coupled to a generally horizontally oriented steel tube 88. The vertically disposed arch legs 82, 84 form first and second carriage sides, broadly designated by the reference numerals 90 and 92. Arches 70, 72 are rigidly braced in spaced-apart parallel relation by upper crossmembers 96, and lower crossmembers 98 which extend transversely between legs 82, 84.

Figure 4:
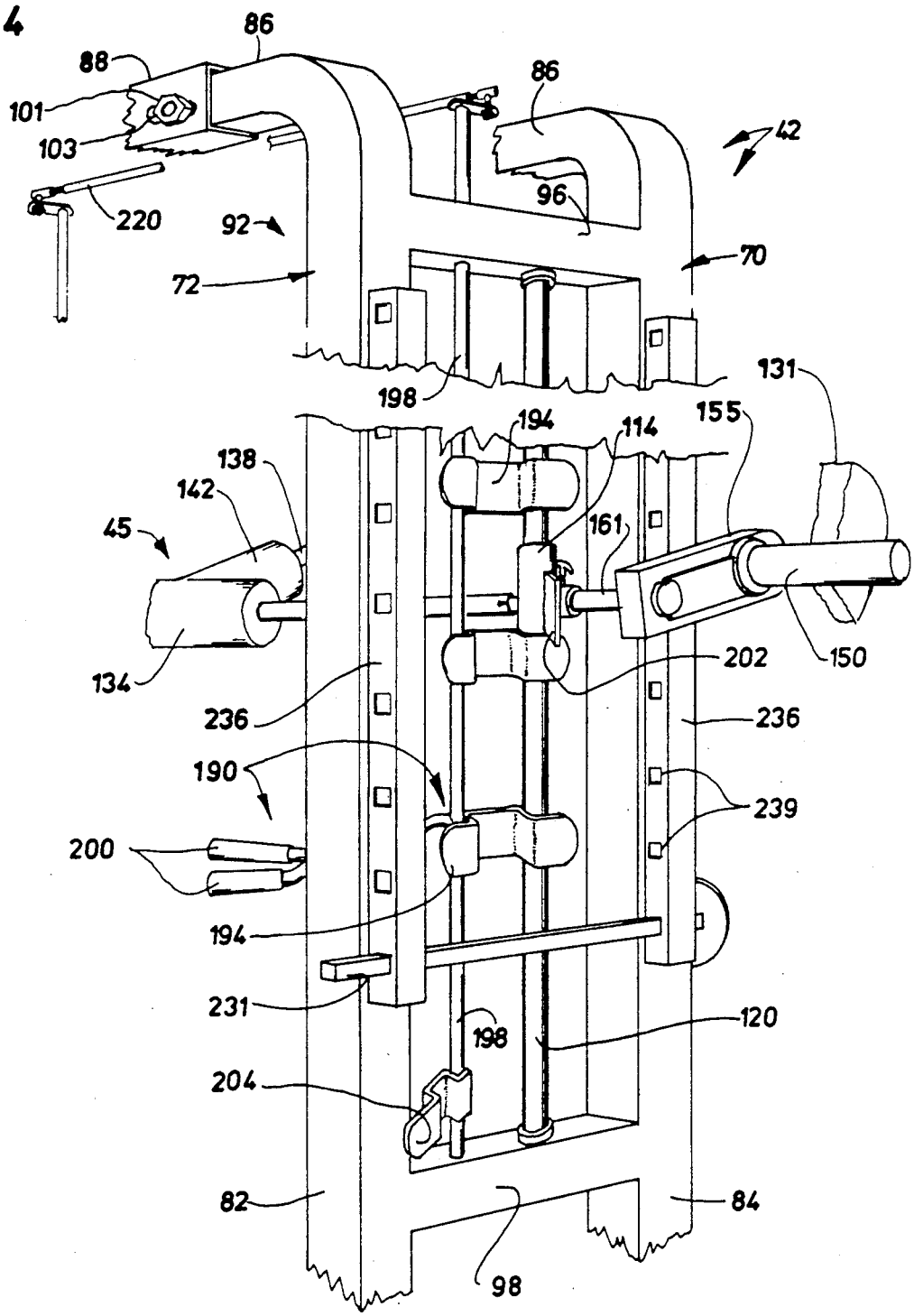
FIG. 4 is a fragmentary, side perspective view illustrating a side of the unit, showing the preferred stop assembly thereof.

In assembly, the arches 70, 72 may be adjusted carefully to prevent subsequent binding. With reference to FIG. 4, bolts 101 penetrate the ends of legs 82, 84 to secure them within tube 88. Alignment slots 103 defined in tubes 88 assure that the carriage sides 90, 92 are properly aligned. Thus undesired misalignment and binding is less likely to occur as the carriage slides along frame 22. The carriage assembly supports the user-engageable weight bar assembly, which has been generally designated by the reference numeral 45.

Figure 2:
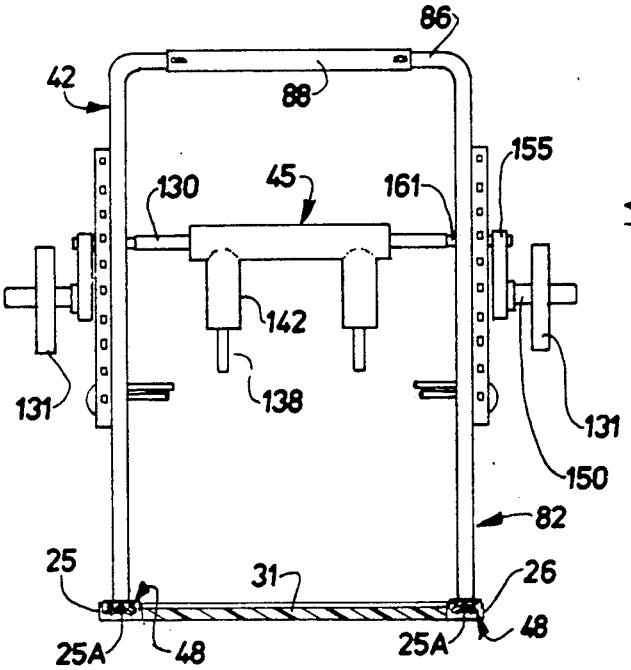
FIG. 2 is a fragmentary, front elevational view thereof.

With reference directed to FIGS. 1, 2, and 4, the preferred weight bar assembly 45 extends horizontally between the carriage sides 90, 92 and it may be moved vertically up and down concurrently with carriage movements. Assembly 45 is slidably coupled by a pair of tubular sleeves 112, 114 to guide rods 120, 122 which extend vertically between crossmembers 96, 98. Sleeves 112, 114 slidably, coaxially captivate rods 120, 122, and facilitate smooth vertical displacement of the weights (FIG. 5).

With reference directed to FIGS. 1, 2, and 4, the weight bar assembly 45 comprises a generally tubular rod 130 which extends horizontally between sleeves 112 and 114 across carriage assembly 42 and above base 31. The weight bar assembly 45 can mount a plurality of suitable weights 131, so that a desired load may be assumed. A collar-like yoke 134 harnesses the bodybuilder to the machine. Yoke 134 comprises a pair of parallel bars 138 which extend outwardly from rod 130 and are padded by a resilient cushion 142.

Figure 5:
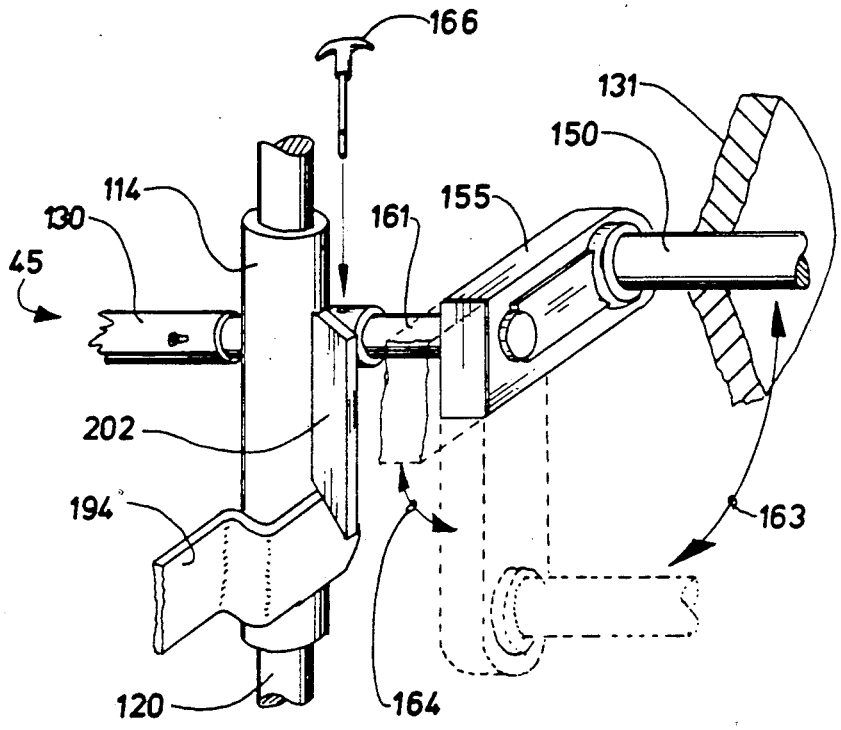
FIG. 5 is an enlarged, fragmentary, perspective view of the weight bar.

The structure of the weight support is best viewed in FIGS. 2, 4, and 5. Rod 130 terminates in a pair of offset weight supports 150, which are angularly spaced apart in parallel relation to the main horizontal rod 130 by rotatable blocks 155. Suitable weights 131 may be temporarily secured upon weight supports 150 so as to provide the desired stress for a particular exercise. As best viewed in FIG. 5, the off-set weight supports 150 and weights 131 may be selectively positioned relative to rod 130 to produce varying downward moments upon the shoulders of the bodybuilder 80 in response to weights 131.

Figure 3:
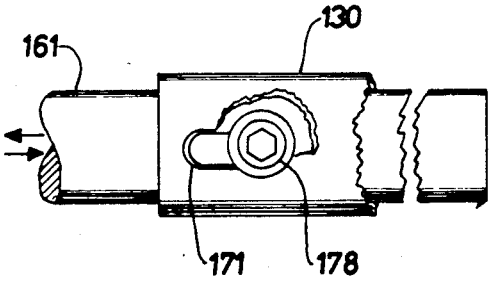
FIG. 3 is an enlarged, fragmentary, front elevational view of the weight bar.

Blocks 155 operatively link the weight rod 130 to the offset weight supports 150. With reference to FIGS. 3 and 5, a rigid shaft 161 extends outwardly from one side of block 155 and is slidably received within the hollow end of the weight rod 130. The opposite side of block 155 receives offset weight supports 150. Thus, by rotating block 155, weight supports 150 are repositioned relative to the weight rod 130 as indicated by arrow 163 in FIG. 4. A rigid drop pin 166 (FIG. 4) penetrates suitable orifices drilled through rod 130 and shaft 161. Pin 166 is temporarily removed to permit rotation of the weight supports 150 and reinserted to lock the weight supports in one of three selectable positions.

Because exact parallel alignment may not be achieved between the carriage sides, weight bar assembly 45 is adapted to resiliently compensate for slight variances in carriage width. As best viewed in FIG. 3, an elongated follower slot 171 is defined in rod 130. The slot 171 is aligned generally with a mounting orifice defined in shaft 161. The rod 130 and shaft 161 are connected by a fastener 178 such as a bolt or the like. Thus, when the shaft 161 is fastened within rod 130, the rod 130 is free to slide axially to adapt to changes in the carriage width. Hence, undesired binding of vertical movement of the weight bar is prevented during performance of various exercises.

Figure 8:
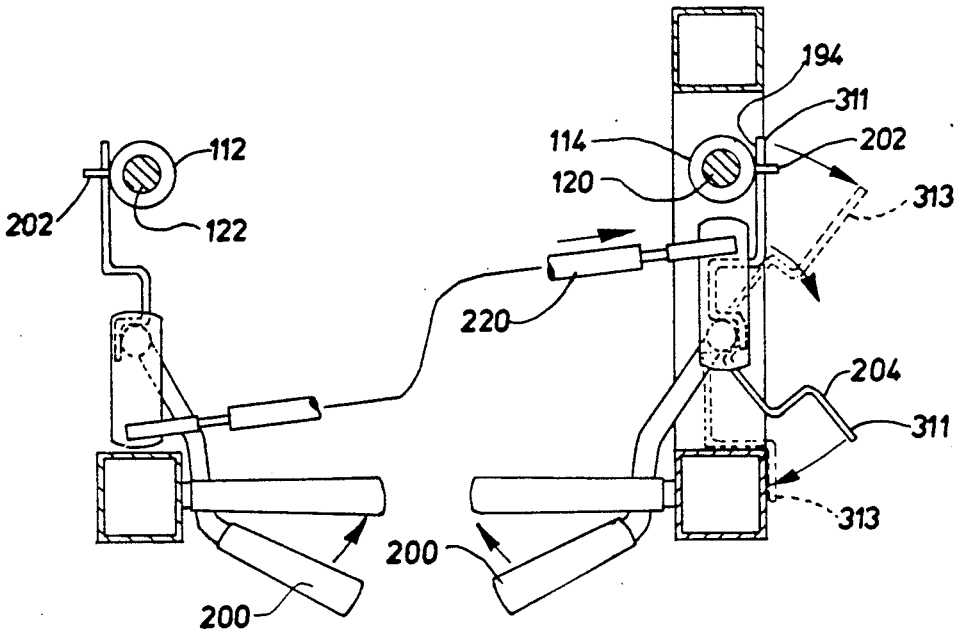
FIG. 8 is a fragmentary, top plan view of the stop assembly thereof.

For safety purposes, it is necessary to limit vertical movement of the weight bar assembly 45 within a predefined range for setup and during the performance of various exercises. With reference to FIGS. 4, 5, and 8, a weight bar restraint system, generally designated by the reference numeral 190, comprises a plurality of wings 194 mounted in spaced apart relation along a rotatable support stanchion 198. Stanchion 198 extends vertically between crossmembers 96, 98 in generally parallel relation to guide rods 120, 122. The stanchions 198 are rotated in response to manipulation of handgrips 200 associated with the front of the carriage assembly 42.

Wings 194 extend outwardly from stanchion 198 and may be rotated between an "open" position, generally indicated at 313 in FIG. 8 and a "closed" position, generally indicated at 311 in FIG. 8. In the open position, wings 194 project outwardly from the carriage sides generally in the direction of the offset weight supports 150. Outward rotation of stanchion 198 and wings 194 past the "open" position is limited by a lower wing 204 which contacts arch leg 82. In the closed position, the wings 194 can rest against sleeves 112, 114 and can obstruct the vertical path of weight bar assembly 45 (FIG. 5). As best viewed in FIGS. 5 and 8, a rigid lug 202 extends outwardly from weight bar sleeves 112, 114. When the restraint system is "closed", the bottom edge of lug 202 contacts wing 194 and prevents further downward movement of the weight bar.

When the bodybuilder has properly positioned himself to commence an exercise, he may release the weight bar assembly to slide freely up and down along guide rods 120, 122 by reaching forward and squeezing handgrips 200 together. As best viewed in FIG. 8, stanchions 198 rotate, extending wings 194 outwardly and unobstructing the path of the weight bar. When the handgrips 200 are released, wings 194 rotate inwardly and rest against guide sleeves 112, 114 in the closed position.

Stanchions 198 are operatively linked by an elongated reciprocating linkage 220, which extends across the top of the carriage 42 (FIGS. 4, 8). Linkage 220 assures synchronized movement of the wings 194 on both sides of the carriage assembly. As the stanchions are rotated by compression of handgrips 200, opposing rotational forces swivel linkage 220. Thus wings 194 rotate the same distance at the same time, and thus assure that the weight bar will be properly positioned parallel to the floor. This enhances the safety of operation of the machine 20, and evenly distributes downward moments exerted by weights 131.

It is especially important to prevent inadvertent dropping of the weight bar during operation. For example, if the bodybuilder 80 experiences a muscle cramp while performing a squat exercise, he might drop the weight bar and sustain a serious injury. Therefore, rigid drop bars 231 (FIG. 4) are provided on either side of the carriage assembly to break the fall of the weight bar if it is dropped.

Drop bars 231 may be selectively positioned at any of a plurality of positions along the carriage sides. As best viewed in FIG. 4, drop bars 231 are supported between a pair of support struts 236 mounted on arch legs 82, 84. Struts 236 comprise a plurality of slots 239 through which the drop bars may be slidably inserted at the desired height. For example, when upright rows are performed with the bodybuilder standing, the drop bars should be positioned at a higher position than would be necessary for the safe performance of bench presses, during which the bodybuilder is generally seated.

OPERATION

Based on my experimentation, the unique adjustment features of the present novel design facilitate more smooth and natural movement of the body during exercising. In the accompanying FIGS. 9 and 10, the machine is illustrated in use by a bodybuilder to perform a typical lunge exercise.

The bodybuilder enters the machine from the frame rear 33. By releasing the pin 166, the bodybuilder may first rotate the weight bar so that the yoke will rest upon his shoulders resting on the back of his neck. By grasping the handgrips 200, the bodybuilder may temporarily release the weight bar so that he may lower or raise it to a comfortable starting height. When the handgrips are subsequently released, the weight bar is safely retained in the desired position by the wings. The weight load may be adjusted by added or removing weights 131 from the weight support bar. The bodybuilder releases the carriage to roll freely forward and backward by releasing the safety latches 29. Finally, the bodybuilder will position the drop bars within corresponding orifices to prevent the bar, if released, from falling below the height of the bodybuilder's shoulders when he is in full lunge position. Then the bodybuilder is ready to begin the exercise.

Figure 9:
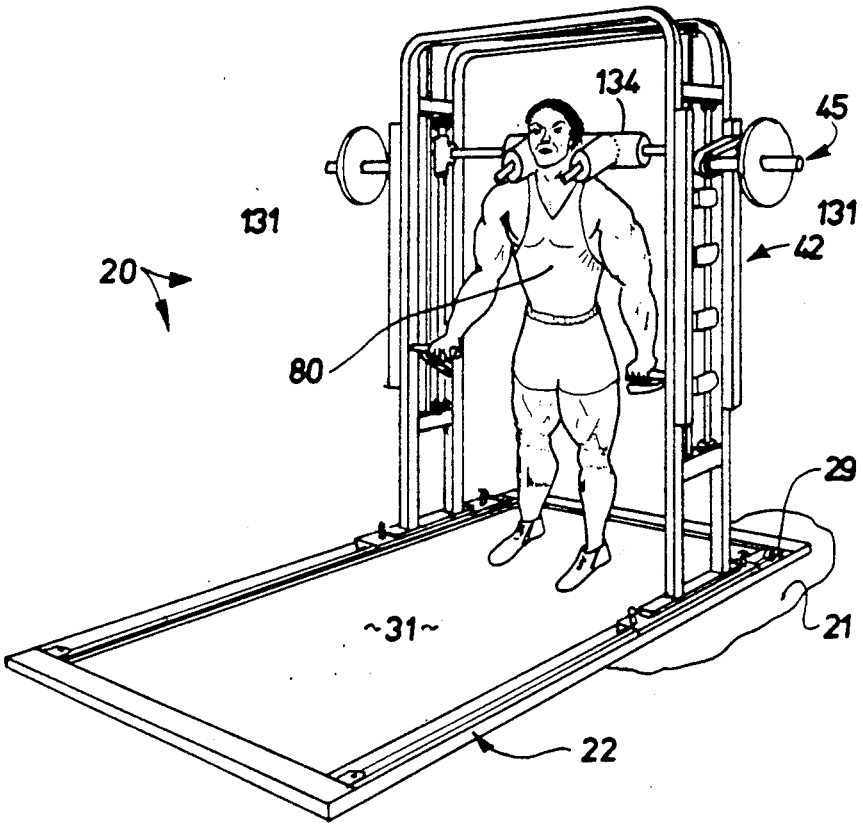
FIGS. 9 and 10 are pictorial views generally illustrating the machine during performance of a lunge exercise.
Figure 10:
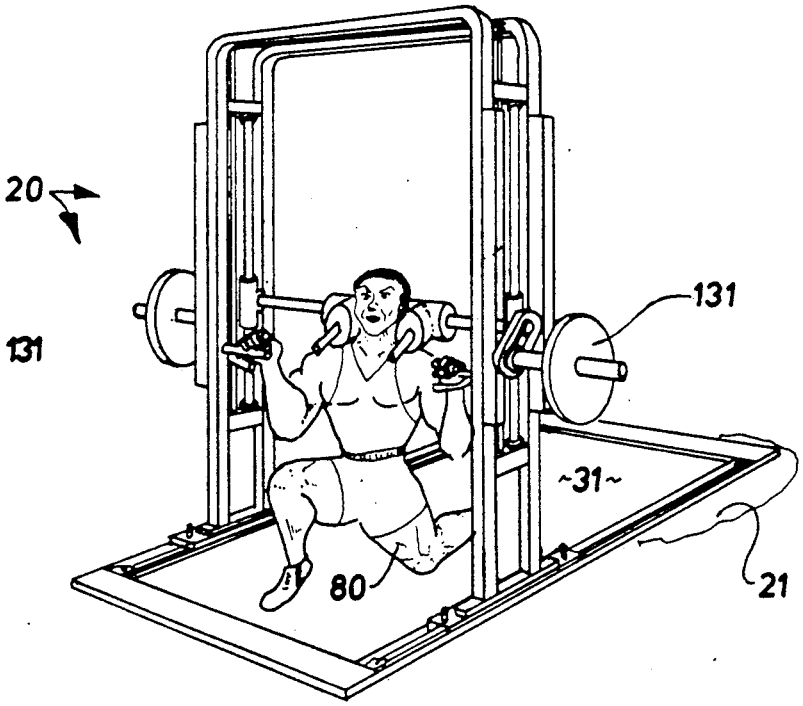

When in the starting position illustrated in FIG. 9, the bodybuilder 80 grasps the handgrips to release the weight bar until the yoke comfortably rests upon his shoulders. The weight bar is positioned relatively high on the carriage. As illustrated in FIG. 10, the bodybuilder then shifts his weight forward and extends his leg outwardly to a semi-crouched lunge position. The bodybuilder's forward motion slides the carriage forward along the rails. Simultaneously, the bodybuilder's shoulders lower, and the weight bar moves downwardly within the carriage. In order to perform repetitions of the lunge, the bodybuilder then shifts his weight to the rearward leg and raises his body back to the initial standing position. Thus the carriage is driven backwards while the weight bar is elevated. In this lunge exercise, the bodybuilder safely and conveniently achieves the benefits of natural movement enjoyed with the corresponding free weight exercise, but is assisted in maintaining proper balance and form while safely using increased weight loads.

By thus allowing the body to move more naturally in two planes rather than one, stress on the joints, tendons, and bone structure are greatly reduced. Proper muscle growth and increased tendon and bone strength may thus be achieved through use of the present machine 20. The machine 20 is thus particularly well-adapted to use for rehabilitating injured or weakened muscles, and for increasing tendon and bone strength.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A machine for use by an exerciser for muscle conditioning, muscle rehabilitation, body building, weight training, and exercising, said machine comprising:

a rigid, generally planar frame adapted to be disposed upon a supporting surface such as the floor of a gymnasium, said frame comprising a front and a back, and a pair of parallel, spaced apart side rails extending generally horizontally between said front and said back;

a resilient, skid-resistant base defined by said frame between said side rails upon which the exerciser may stand;

a carriage assembly movable by said exerciser relative to said frame, said carriage assembly comprising:

a pair of spaced apart vertically upwardly extending sides slidably supported upon said frame rails for movements generally between said frame front and said frame back, each side comprising vertical guide rod means;

weight bar means operatively extending between said sides for supporting user-selected weights, said weight bar means comprising:

yoke means engageable by said exerciser;

sleeve means coupled to said guide rod means facilitating slidable, generally vertical, axial weight bar movements with respect to said sides;

means for rotatably coupling said weight bar means to said sleeve means to facilitate torsional displacements of said weight bar means concurrently with up and down movements thereof; and, means for dynamically varying in length for resiliently compensating for non-parallel alignment of said carriage sides;

restraint means for resting said weight bar means at a desired elevation above said floor to temporarily support the weights, said restraint means comprising a rotatable, vertical stanchion associated with each of said carriage sides, said stanchion being spaced apart from said guide rod means and comprising wing means adapted to be rotated into position to selectively contact said weight bar means to at least temporarily hold same;

compensation linkage means for synchronizing rotation of said vertical stanchions on each of said carriage means sides;

drop bar means for preventing injury to said bodybuilder by limiting downward travel of said weight bar in response to inadvertent release or dropping of said weight bar means, said drop bar means comprising pairs of support struts disposed along said carriage sides for slidably receiving said weight bar means;

means for joining and retaining said carriage sides in proper parallel alignment;

whereby said carriage means may move relative to said frame concurrently with movements of said weight bar means to facilitate the practice of weighted lunges or similar exercises by said exerciser.

2. The machine as defined in claim 1 including means for temporarily locking said carriage assembly in a stationary position at the back of the frame or at the front of said frame.

3. A bodybuilding machine for use by an exerciser for conditioning, rehabilitating, and exercising the legs and lower body muscles, said bodybuilding machine comprising:

a rigid frame adapted to be disposed upon a supporting surface such as the floor of a gymnasium, said frame comprising a front and a back, a pair of parallel, spaced apart side rails extending generally horizontally perpendicularly between said front and said back, and a resilient, skid-resistant floor secured within said frame;

a carriage assembly adapted for selective movement relative to said frame, said carriage assembly comprising:

a pair of rigid, spaced apart vertically upwardly extending sides slidably supported upon said frame rails for movements generally between said frame front and said frame back, each side comprising vertical guide rod means;

weight bar means operatively extending between said sides for supporting a user-selected load of weights, said weight bar means comprising sleeve means concentrically coupled to said guide rod means for slidable axial movement with respect thereto and means for rotatably coupling said weight bar means to said sleeve means to facilitate rotation of said weight bar means concurrently with up and down movements thereof;

arch means joining said sides and compensating for non-parallel alignment of said carriage sides, said last-mentioned means comprising tube means for slidably receiving the upper ends of said carriage sides and calibrated slot means penetrated by fastener means for securing said carriage ends;

means for temporarily locking said carriage assembly in a stationary position relative to said frame;

restraint means for selectively, temporarily restraining said weight bar means at a desired elevation above said floor, said restraint means comprising a rotatable vertical stanchion associated with each of said carriage sides, said stanchion being spaced apart from said guide rod means and comprising wing means adapted to be rotated into position for selectively supporting and releasing said weight bar means for slidable displacement along said guide rod means;

compensation linkage means extending between opposite sides of said carriage assembly for synchronizing rotation of said stanchions; and, safety brace means for preventing injury to said exerciser from inadvertent release of said weight bar means from said carriage, said safety brace means comprising a safety drop bar transversely mounted between slotted struts associated with each of said carriage sides.

4. A bodybuilding machine for use by an exerciser for conditioning, rehabilitating, and exercising the legs and lower body muscles, said bodybuilding machine comprising:

a rigid frame adapted to be disposed upon a supporting surface such as the floor of a gymnasium, said frame comprising a front and a back, a pair of parallel, spaced apart side rails extending generally horizontally perpendicularly between said front and said back, and a resilient, skid-resistant floor secured within said frame;

a carriage assembly adapted for selective movement relative to said frame, said carriage assembly comprising:

a pair of rigid, spaced apart vertically upward extending sides slidably supported upon said frame rails for movements generally between said frame front and said frame back, each side comprising vertical guide rod means;

weight bar means operatively extending between said sides for supporting a user-selected load of weights, said weight bar means comprising sleeve means concentrically coupled to said guide rod means for slidable axial movement with respect thereto and means for rotatably coupling said weight bar means to said sleeve means to facilitate rotation of said weight bar means concurrently with up and down movements thereof;

arch means joining said sides and compensating for non-parallel alignment of said carriage sides, said last-mentioned means comprising tube means for slidably receiving the upper ends of said carriage sides and calibrated slot means penetrated by fastener means for securing said carriage ends;

means for temporarily locking said carriage assembly in a stationary position relative to said frame;

restraint means for selectively, temporarily restraining said weight bar means at a desired elevation above said floor, said restraint means comprising a rotatable vertical stanchion associated with each of said carriage sides, said stanchion being spaced apart from said guide rod means and comprising wing means adapted to be rotated into position for selectively supporting and releasing said weight bar means for slidable displacement along said guide rod means;

compensation linkage means extending between opposite sides of said carriage assembly for synchronizing rotation of said stanchions;

safety brace means for preventing injury to said exerciser from inadvertent release of said weight bar means from said carriage; and, wherein said weight bar means comprises means for dynamically varying in length for resiliently compensating for non-parallel alignment of said carriage sides.

* * * * *